US011009305B2

(12) United States Patent
Akyol

(10) Patent No.: US 11,009,305 B2
(45) Date of Patent: May 18, 2021

(54) THREE COLUMNED MAGAZINE STRUCTURE FOR FIREARMS

(71) Applicant: ARMSAN SILAH SANAYI VE TICARET ANONIM SIRKETI, Istanbul (TR)

(72) Inventor: Nejat Akyol, Istanbul (TR)

( * ) Notice: Subject to any disclaimer, the term of this patent is extended or adjusted under 35 U.S.C. 154(b) by 0 days.

(21) Appl. No.: 16/642,633

(22) PCT Filed: Jul. 13, 2018

(86) PCT No.: PCT/TR2018/050369
§ 371 (c)(1),
(2) Date: Feb. 27, 2020

(87) PCT Pub. No.: WO2019/108152
PCT Pub. Date: Jun. 6, 2019

(65) Prior Publication Data

US 2020/0348097 A1 Nov. 5, 2020

(30) Foreign Application Priority Data

Oct. 4, 2017 (TR) ..... 2017/14986

(51) Int. Cl.
*F41A 9/72* (2006.01)

(52) U.S. Cl.
CPC ..... *F41A 9/72* (2013.01)

(58) Field of Classification Search
CPC ..... F41A 9/72; F41A 9/73; F41A 9/26; F41A 9/18; F41A 9/19; F41B 11/55; F41C 7/02; F41C 23/16
USPC ..... 42/17, 19, 49.01, 87
See application file for complete search history.

(56) References Cited

U.S. PATENT DOCUMENTS 1,420,471 A * 6/1922 Carter ..... F41A 9/72 42/19
2,237,291 A * 4/1941 Carter ..... F41A 9/72 42/19
2,482,398 A * 9/1949 Blanton ..... F41A 9/82 42/6
3,757,449 A * 9/1973 Schindler ..... F41A 9/83 42/87
3,808,723 A * 5/1974 Erixon ..... F41A 9/38 42/6
4,166,409 A * 9/1979 Gevers ..... F41A 21/482 89/128
4,905,395 A * 3/1990 Wagner ..... F41A 9/72 42/17
5,119,575 A * 6/1992 Gajdica ..... F41A 9/72 42/19
6,481,137 B2 * 11/2002 Kornberger ..... F41A 9/28 42/39.5

(Continued)

OTHER PUBLICATIONS

International Search Report for corresponding PCT/TR2018/050369.
Written Opinion of the ISA for corresponding PCT/TR2018/050369.

*Primary Examiner* — Michael D David
(74) *Attorney, Agent, or Firm* — Egbert Law Offices, PLLC

(57) ABSTRACT

A novel three columned magazine structure with high cartridge capacity developed for automatic shotguns that are able to perform rapid fires, which enables the firearm to have more than one type of cartridge at the same time ready to be fired from the shotgun structure, and allows different type of cartridge structures to be fired in desired order.

5 Claims, 16 Drawing Sheets

(56) References Cited

U.S. PATENT DOCUMENTS

| | | | | |
|---|---|---|---|---|
| 6,877,265 | B2 * | 4/2005 | Hajjar | F41A 9/68 42/19 |
| 7,237,469 | B2 * | 7/2007 | Murello | F41A 3/40 89/187.01 |
| 7,752,795 | B1 * | 7/2010 | Mautone Medvedeo | F41A 9/26 42/19 |
| 7,779,571 | B1 * | 8/2010 | Roth | F41A 9/26 42/17 |
| 8,122,635 | B2 * | 2/2012 | Pullicar | F41C 23/16 42/71.01 |
| 8,353,123 | B2 * | 1/2013 | Pullicar | F41A 9/72 42/72 |
| 8,726,557 | B2 * | 5/2014 | Stone | F41G 11/003 42/71.01 |
| 8,733,007 | B2 * | 5/2014 | Hatfield | F41A 9/35 42/1.02 |
| 8,819,976 | B1 * | 9/2014 | Kellgren | F41C 23/04 42/6 |
| 9,015,979 | B2 * | 4/2015 | Safewright, Jr. | F41A 9/71 42/49.02 |
| 9,347,737 | B2 * | 5/2016 | Troy | F41A 35/06 |
| 9,400,148 | B2 * | 7/2016 | Pittman | F41A 9/82 |
| 10,151,546 | B2 * | 12/2018 | Baker | F41A 9/71 |
| 10,697,723 | B1 * | 6/2020 | Hall | F41C 7/02 |
| 10,739,091 | B2 * | 8/2020 | Mesco | F41A 9/26 |

* cited by examiner

THREE COLUMNED MAGAZINE STRUCTURE FOR FIREARMS

TECHNICAL FIELD OF THE INVENTION

The invention relates to a novel three columned magazine structure developed for automatic rifles and enabling to have more than one type of cartridge at the same time ready to be fired from firearm's structure.

STATE OF THE ART

There is a good number of different type of shotgun structures in the state of the art. The most preferred models of shotgun structures today are automatic or semi-automatic shotgun structures that can be rapid fired successively. These structures are especially preferred by shooters who use rapid fire.

Automatic pump rifle structures allowing for rapid fire have magazine structures that can be in various types and in which cartridges to be fired successively are positioned. Said magazine structures allows cartridges filled therein to be successively fired via automatic pump rifles. When these state of the art magazine structures are examined, it can be seen that there are two main magazine structures as box magazine structures and tubular magazine structures.

When box shaped magazine structures in the state of the art are examined it can be seen that commonly two models are used. First one of these models is the magazine structure which is used also in machine gun structures and has a form similar to magazine structures that can be readily inserted by shooter using single hand, in which cartridges are positioned by arranging such that they are in a single line one on the top of the other, and which has a spring structure in its base portion, and which is used by inserting it inside magazine loading port in lower part of barrel of pump rifle structure. The cartridges which are in single line arranged one on the top of the other move upwardly by means of a spring located in the base as firing is performed. In these structures, when the cartridges inside the magazine are finished, shooter needs to insert a full cartridge fresh box magazine directly in place of the magazine used. Or the empty box magazine structure in question needs to be reloaded manually with cartridges after being ejected from firearm body.

Second model of box shaped magazine structures is drum magazine structure which is in cylindrical form. In these structures, cartridges are arranged in a single line side by side next to inner surface of rounded edge of cylindrically formed magazine structure. Drum magazine structures are used by placing them such that their round formed edges correspond to magazine loading port in lower portion of firearm structure's barrel. As shooting is performed, cartridges inside the magazine box rotate in the inner surface of rounded edge. When cartridges of drum magazine structures are finished, a full cartridge fresh drum magazine box needs to be inserted directly by shooter again.

In tubular magazine structure which is the other magazine model commonly used in the state of the art, magazine structure in question is used by being positioned under barrel in parallel to the barrel. In these magazine structures, cartridges to be fired are placed one by one inside the magazine structure by shooter. Cartridges placed inside magazine are aligned successively end to end in a single line. Cartridge to be fired is received into barrel through gap point at back end of magazine structure connected to barrel. As shooting is performed, cartridge at the end of tubular magazine structure is fed into barrel by means of a spring structure placed in front section of tubular magazine structure. Cartridge loading process into magazine is performed when cartridges are decreased or totally finished depending on choice of shooter. Since cartridges are arranged end to end in tubular magazine structures, it is out of question to reload cartridge during firing. Only after shooting, cartridge reloading is possible.

Main problem encountered concerning magazine structures that are used in rapid fire automatic pump rifles in the state of the art is capacity issue. Those magazines have restricted capacity due to their designs. Tubular magazine structures can only have a number of cartridges length of which in total cannot be longer than barrel and thus causing shooters to interrupt their shots frequently by cartridge reloading process during rapid fire. In the box magazine structures, restricted and small number of cartridges can be loaded into magazine depending on the design and rapid fire performance is interrupted by reloading fresh magazine when it is emptied. Therefore, restricted capacities of magazine structures of the state of the art pose problem for shooters desiring to perform a good number of rapid fire.

In the present art, some shooter may sometime desire to fire different type of cartridges while using their automatic pump rifle structures. When taken magazines of said automatic pump rifles of the state of the art into consideration, different type of cartridge firing cannot be performed right in desired manner. In the tubular magazine structures, if different types of cartridges are desired to be fired, then existing cartridges placed in magazine are ejected out and cartridges desired to be used should be loaded one by one into the magazine. That causes shooters to spend long time for cartridge reloading process and thus leading to a serious waste of time. In the box magazine structures, if different types of cartridges are desired to be fired, then existing magazine structure is directly changed and a box magazine structure having cartridge structure that is desired to be fired needs to be inserted in place of it. Hence, when it is desired to fire different type of cartridges, magazine should be changed completely and thereby making rapid fire impossible during shooting.

Because of the fact that the magazines of said automatic pump rifles in the present art are emptied in a short time and the time loss during their reloading process, users desiring to perform rapid fire cannot create straight concentration they desired. Taking the capacities of said magazine structures and their loading methods into consideration, it is observed that targeting process is frequently interrupted in cases where rapid fires are required. That results in inefficient shootings by users and decreases percentages of target shootings by users.

AIM OF THE INVENTION

Aim of the invention is to provide a novel firearm structure that can perform outlasting rapid fires without requiring cartridge reloading for users desiring to perform rapid fires with automatic pump rifles.

Another object of the invention is to provide a novel magazine structure allowing for cartridge reloading process when shooting is being performed with automatic pump rifles simultaneously.

A further object of the invention is to provide shooters shooting with automatic pump rifles to be able to fire different type of cartridges in a very short time whenever they want.

Another object of the invention is to provide a novel magazine structure that allow automatic pump rifle shooters desiring to fire different type of cartridge in regular turn to be able to change cartridge structures instantaneously without losing time.

Another object of the invention is to provide a novel high cartridge capacity magazine structure allowing for more rapid fire continuously with automatic pump rifles.

A further object of the invention is to provide a novel automatic pump rifle magazine having a structure that is able to fire many different type of cartridge structures.

Another object of the invention is to provide a novel automatic pump rifle magazine that allow shooters to unload cartridges present in the magazine in a very short time and quite easily whenever they want.

1. Magazine Structure
2. Magazine Body
3. Magazine Column
4. Magazine Spring
5. Magazine Lid
6. Column Tap
7. Bearing Gap
8. Bearing Housing
9. Central Bearing
10. Spring Tap
11. Firearm Body
12. Barrel
13. Magazine Port
14. Disc Structure
15. Barrel Housing
16. Main Cartridge Gap
17. Pin Housing
18. Pin Structure
19. Engagement Gap
20. Assembly Gap
21. Extra Cartridge Gaps
22. Cartridge Retainer
23. Centering Housing
24. Inclined Protrusion
25. Button
26. Inhibitor
27. Retainer Spring
28. Stabilizer Structure
29. Locking Housings
30. Locking1 latch
31. Locking Extractor
32. Latch Assembly Hole
33. Finger Housing
34. Trigger Guard
35. Locking Spring
36. Locking Pin
37. Spring Gap
38. Trigger

DESCRIPTION OF THE INVENTION

The present invention relates to a novel three columned magazine structure (1) which is developed for automatic shotgun structures used for performing rapid fires, and which has a high cartridge capacity, and which allows different types of cartridge structures to be fired in desired order.

Figure 1:
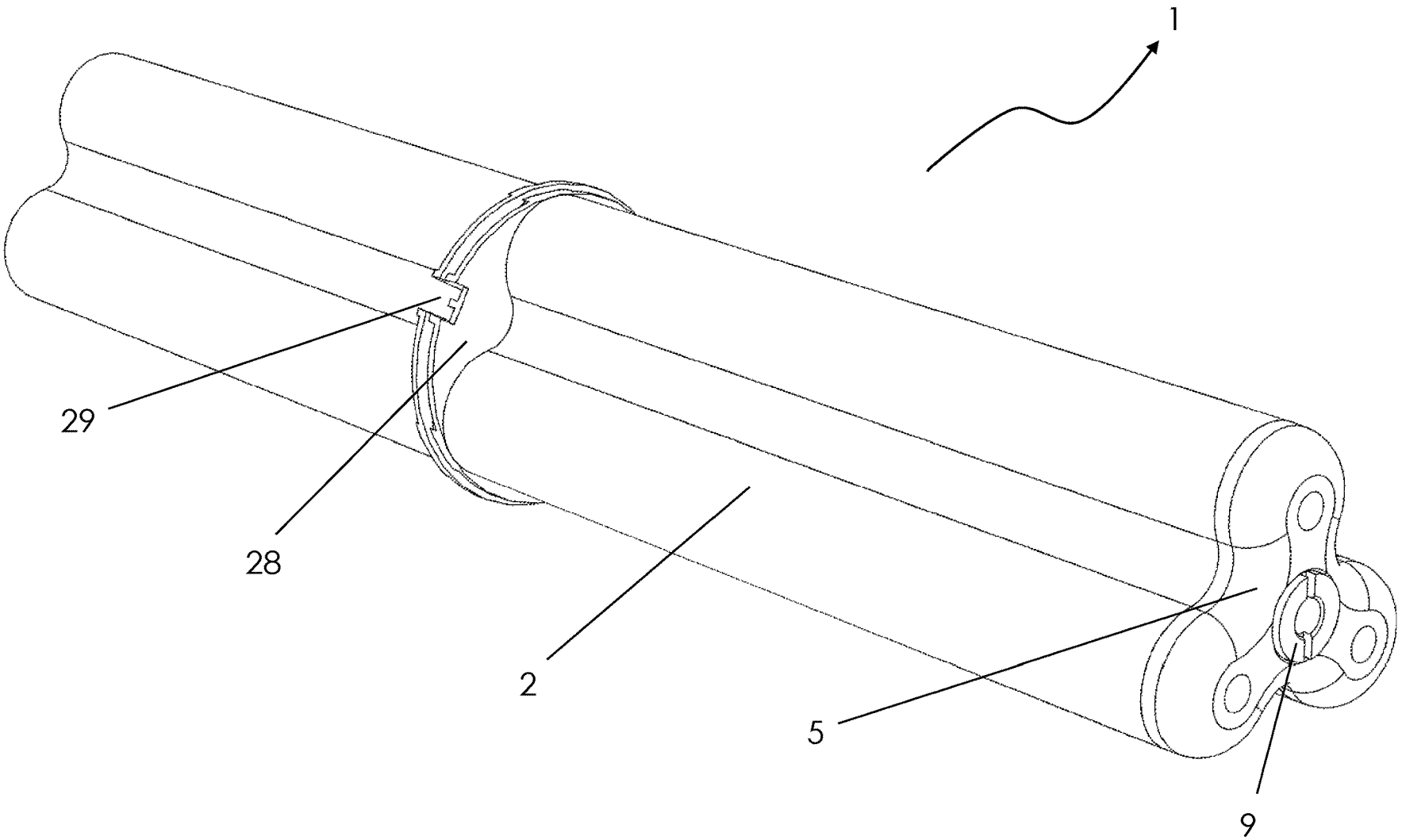
FIG. 1, Magazine Structure—Front Perspective
Figure 2:
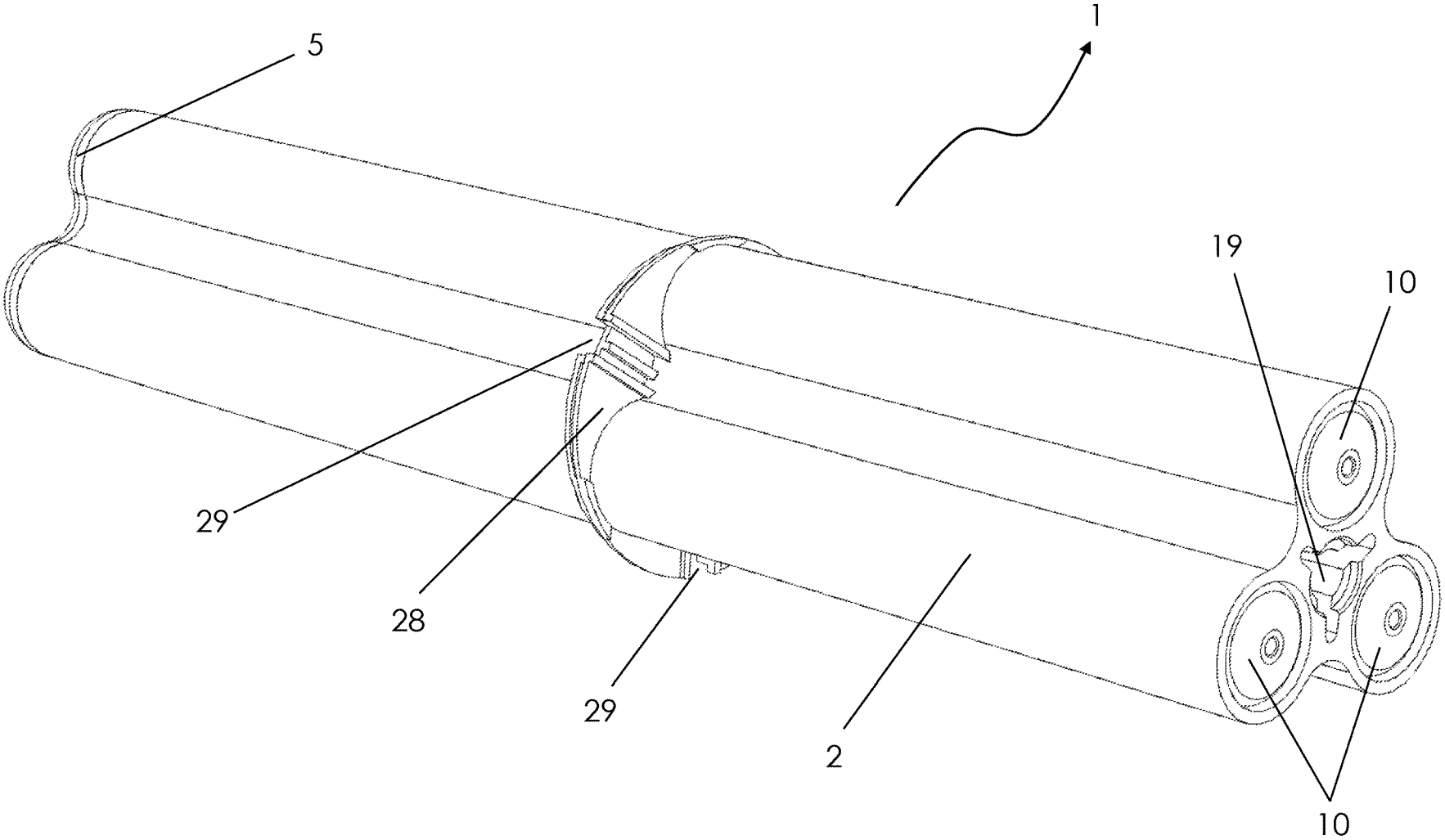
FIG. 2, Magazine Structure—Rear Perspective

Said magazine structure (1) is a structure that came in view as a result of improving tubular type magazine structures (1) by considering their operating logic in detail. As can be seen in FIGS. 1 and 2, subject matter magazine structure (1) is basically in a triple tubular type magazine structure (1) form. It has a structure that came in view as a result of the fact that magazine structure (1) having three identical tubes which are equidistant with each other is produced uniformly.

Figure 3:
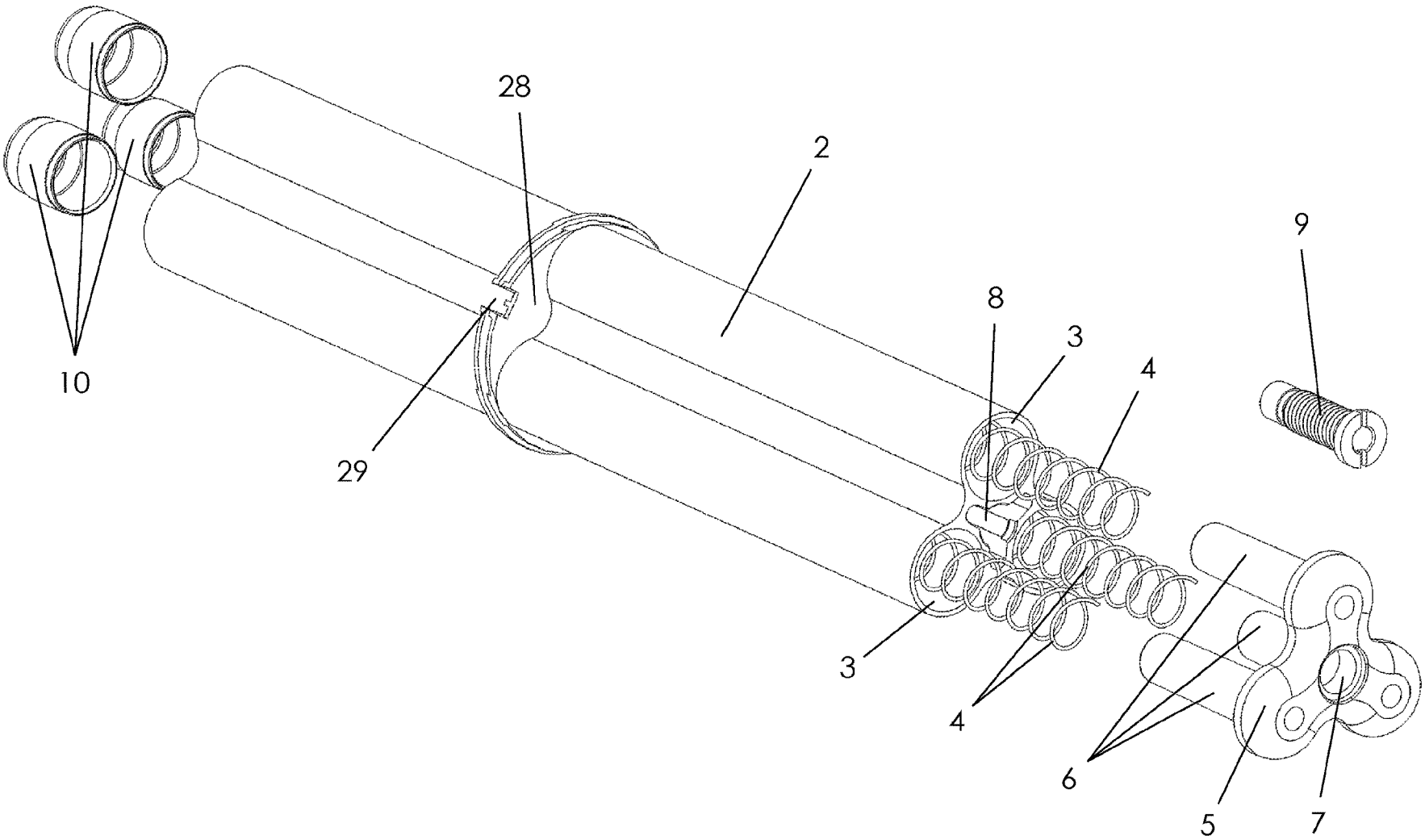
FIG. 3, Demounted Magazine Structure—Front Perspective

FIG. 3 shows demounted view of parts constituting the magazine structure (1). Magazine structure (1) has a uniform magazine body (2). Magazine body (2) has three tubular magazine column (3) which have equal sizes and positioned such that they are in equal distance with each other. When demounted, both ends of the magazine column (3) are open. After the magazine structure (1) is mounted, as can be seen also in FIG. 2, both ends of the magazine column (3) is closed. In mounted form of the magazine structure (1), an end of the magazine column (3) has cylindrically formed spring taps (10) having equal sizes such that each magazine column (3) has one. There are three magazine springs (4) having equal sizes which lie within magazine columns (3) in a manner to fit in completely and to be one for each magazine column (3) at the back of spring taps (10). Spring taps' (10) surfaces and inner sides facing the magazine springs (4) are empty. Hence, the spring taps (10) are in cylindrical lid shape. The magazine springs (4) enter slightly into the spring taps (10) while they are positioned such that they correspond to surface of spring taps (10) having gaps. On the other end of the magazine springs (4) having spring taps (10) on their one end, there is a magazine lid (5) which is uniform and is in a structure such that it fully fits each three magazine columns (3) at the end of magazine body (2) that has no spring taps (10). Magazine lid (5), completely covers the end of magazine body (2) into which it is plugged by means of its protrusion-like formed three column taps (6). These column taps (6) located on the magazine lid (5) are in sizes to fully fit into magazine columns and are in position to be seated in the magazine columns.

Magazine lid (5) which is placed on one end of the magazine body (2) has a bearing gap (7) right on its center. There is also a bearing housing (8) which is in a hole shape on surface of the magazine body (2) right on which said bearing gap (7) fits. Central bearing (9) shown in FIG. 3, is positioned into the bearing gap (7) of the magazine lid (5) that is positioned on the magazine body (2). The central bearing (9) positioned into bearing gap (7) in a manner to completely fit also fits to the bearing housing (8) that is located on the magazine body (2). By means of the fact that the central bearing (9) is fixed by being fitted in both the bearing gap (7) and the bearing housing (8), the magazine lid (5) and the magazine body (2) are strongly mounted to each other.

Mounting of the magazine structure (1) is completed by positioning related parts constituting the structure on the magazine body (2) respectively. Primarily, spring taps (10) which are in sizes to pass through the magazine columns (3), are positioned in the end portion of the magazine columns (3) such that they will be inside the magazine body (2) where there is no bearing housing (8), and will be one for each magazine column (3). Then the magazine springs (4) are positioned inside the magazine columns (3) through the end portion of the magazine body (2) having bearing housing (8) in a manner that each magazine column (3) has one spring. During this process, end portions of the magazine springs (4) slightly move into the spring taps (10) and fit into the spring taps (10).

After the magazine springs (4) are positioned inside the magazine columns (3), magazine lid (5) is seated to the end of magazine body (2) having bearing housing (8) such that each column tap (6) enters into one magazine column (3). When placing the magazine lid (5) on the magazine body (2), free ends of the magazine springs (4) slightly enters into the respective column taps (6) a fair amount. Thus, each of the magazine springs (4) in the magazine columns (3) is placed between two structure such that there will be the spring tap (10) on one side and the magazine lid (5) on the other side. The central bearing (9) is placed into the bearing housing (8) on the magazine body (2) by passing through the bearing gap (7) located on the magazine lid (5) in order that the magazine lid (5) placed on the end of magazine body (2) can be fixed. Locking is ensured by slightly rotating the central bearing (9) placed into the bearing housing (8) and the magazine lid (5) is fixed onto the magazine body (2). Thus, mounting of the magazine structure (1) is completed.

Figure 5:
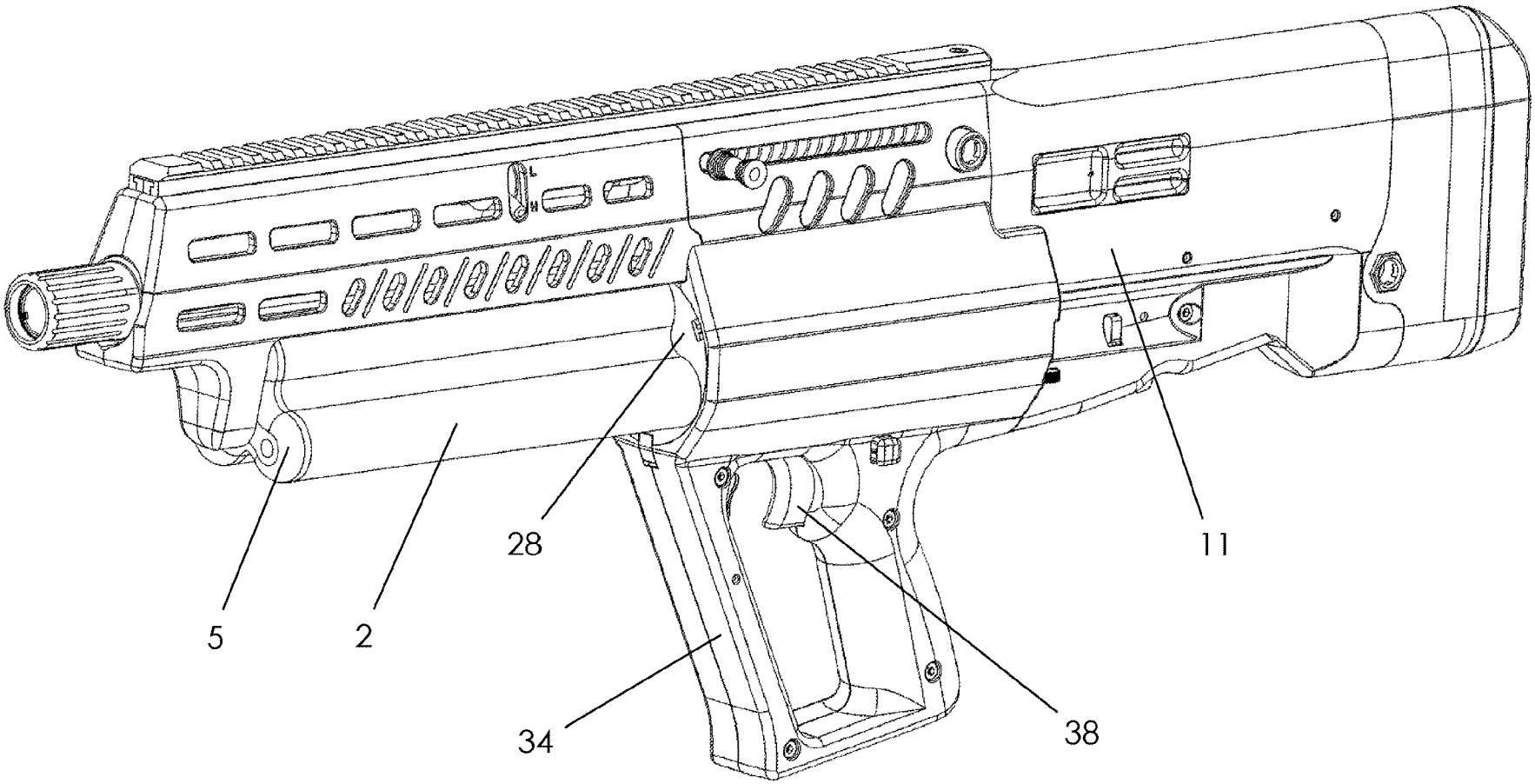
FIG. 5, Firearm Structure—Front Perspective

The firearm structure in which the subject matter magazine structure (1) will be used has a design suitable for the magazine structure (1). As shown in FIG. 5, the magazine structure (1) is mounted to firearm body (11) such that one of the magazine columns (3) will be upper than the other two magazine columns (3) according to the ground and will be right under barrel (12). Said assembly is done such that the end of the magazine body (2) having magazine lid (5) will be directed to same direction with the barrel (12).

The magazine structure (1) is placed to magazine port (13) in the form of a gap located right above trigger such that its open end without magazine lid (5) enters into the firearm body (11). The central bearing (9) which is covered by magazine lid (5) and located on the end of the magazine structure (1) that is directed to same way with the barrel (12) ensures that the outer end portion of the magazine structure (1) is mounted to a suitable structure located under the barrel (12) owing to its hollow structure. Thereby it is ensured that the magazine structure (1) is completely secured on the firearm body (11).

Figure 6:
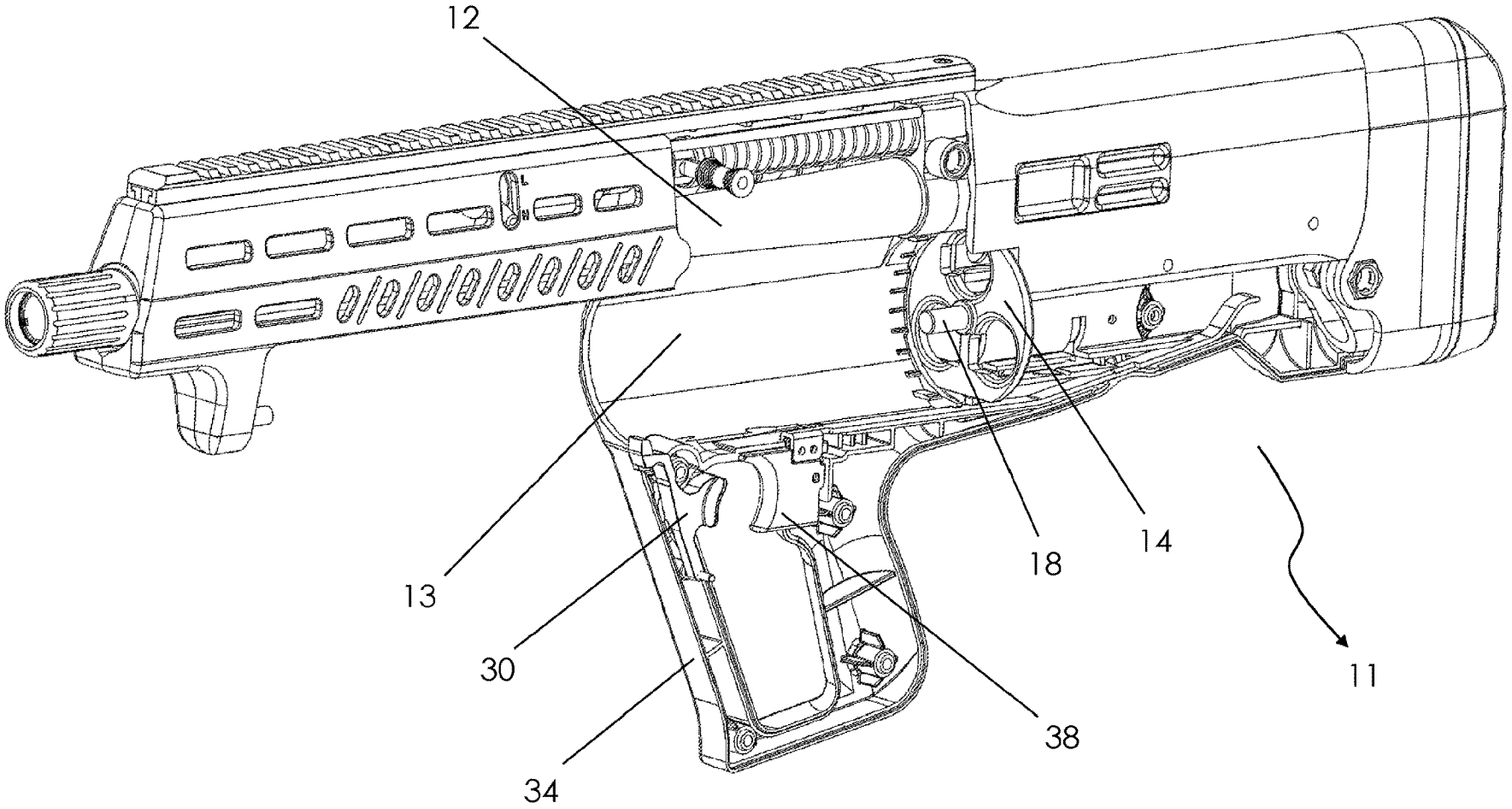
FIG. 6, Magazine Structure and Firearm Structure as Half of its Body Removed—Front Perspective FIG. 7, Disc Structure—Front Perspective FIG. 8, Disc Structure—Rear Perspective FIG. 9, Positions of Magazine Structure, Disc Structure, Barrel and Cartridge catches According to Each Other Inside the Firearm Structure FIG. 10, Positions of Disc Structure and Cartridge catches According to Each Other Inside the Firearm Structure—Upper Perspective FIG. 11, Perspective View of the Cartridge Catches FIG. 12, Firearm Structure—Rear Perspective FIG. 13, Close View of Cartridge Loading Port FIG. 14, View of Locking Latch Body as Half of It Removed Inside the Firearm Structure FIG. 15, Locking Latch—Front Perspective FIG. 16, Locking Latch—Rear Perspective The parts shown in the figures are enumerated individually and names of the parts corresponding to these numbers are as follows.

Disc structure (14), as can also be seen in FIG. 6, is positioned to outlet portion of the open end of the magazine structure (1) placed into the magazine port (13). Main function of the disc structure (14) is to ensure that cartridges to be fired is properly loaded to the barrel and that the connection between the magazine structure (1) and firearm mechanism is optimized.

When the disc structure is viewed from rear and front side, it can be seen that it has four rounded holes through which cartridges can pass. Three of the said rounded holes which are at lower side according to ground level has dimensions to exactly fit to the magazine columns (3) of the magazine structure (1). And the fourth hole is positioned such that it will be right above these three holes. Said hole structure that is the top of the disc structure (14) is barrel housing (15) and correspond to a point where the barrel (12) structure engages. Main function of the barrel housing (15) is to ensure that assembly axes of the barrel (12) structure back end of which is fitted in it and of the magazine structure (1) are always in the same position according to each other. The barrel housing (15) is a fair amount protruded towards the barrel (12) muzzle in order that the barrel (12) structure is properly seated. Back end of the said barrel (12) structure enters into the barrel housing (15) and extends a fair amount outwardly.

The disc structure (14) is positioned inside the firearm body (11) such that its three hole corresponds to the open magazine columns (3) of the magazine structure (1) placed into the firearm body (11). Therefore, the disc structure (14), is located in the firearm body (11) and is in contact with the magazine structure (1) such that it corresponds to open end of the magazine structure (1). The magazine column (3), keeping the cartridge to be fired, belonging to the magazine structure (1) positioned to the magazine port (13) corresponds to main loading port (16) in the center of the disc structure (14). The main loading port (16) is located right under the barrel housing (15).

Right under the main loading port (16), there is a pin housing (17) which is so positioned that it will be right at the center of the three holes that are on the lower part of the disc structure (14). Pin housing (17) is connected to the magazine structure (1) via one pin structure (18) passed through of it and thus ensuring that disc structure (14) and the magazine structure (1) are fixed to each other. In order to ensure said fixation, other end of the pin structure (18) is positioned to engagement gap (19) located on the magazine body (2) having open magazine columns (3). The engagement gap (19) is structure formed as a hole located on the magazine body (2) such that it is right on the center of the open magazine columns (3).

In order that the most proper connection is ensured between the magazine structure (1) and the firearm mechanism, an assembly gap (20) is positioned on the top of the disc structure (14), above the barrel housing (15). Said assembly gap (20), ensures that mechanism rail of the respective firearm mechanism fits exactly thereon. Therefore, gap shape of the assembly gap (20) can vary according to the mechanism rail that aligns the mechanism of the firearm structure in which it is used according to the barrel (12). Accordingly, as can be seen from the disc structures of FIGS. 7 and 8, edge structures forming the assembly gap (20) and located on edges of the assembly gap (20) in a protrusion shape can be in different shapes and/or lengths depending on the structure of the respective mechanism rail.

Two hole structures that are side to side at lower part of the disc structure (14) are gaps of extra cartridges (21). Extra cartridge gaps (21) correspond right to magazine columns (3) that are on the lower portion, and side to side during assembly of the magazine structure (1) on the firearm body (11). Extra cartridge gaps (21) face the magazine columns (3) in which the cartridges not yet to be fired are stored.

Hence, cartridge loading and unloading processes of the magazine structure (1) are executed through the extra cartridge gaps (21).

The main cartridge gap (16) on the disc structure (14) corresponds to the magazine column (3) which has the cartridges to be fired. Thus, the cartridges to be fired are transmitted to the mechanism by passing through the main cartridge gap (16). At this point, movements of the cartridge may alter according to the mechanism structure of the firearm structure. However, the cartridge structure coming from the main cartridge gap (16) is finally positioned into the barrel (12) from the rear end of the barrel (12) structure. The cartridge structure shot by being fired after it is loaded into the barrel (12) passes through the barrel housing (15) during outgoing. Thus, the cartridge taken from the magazine column (3) firstly transmitted to the mechanism by passing through the main cartridge gap (16) and then exits by passing through the barrel housing (15) as it passes through the barrel (12) located in the barrel housing (15) during shooting.

Figure 12:
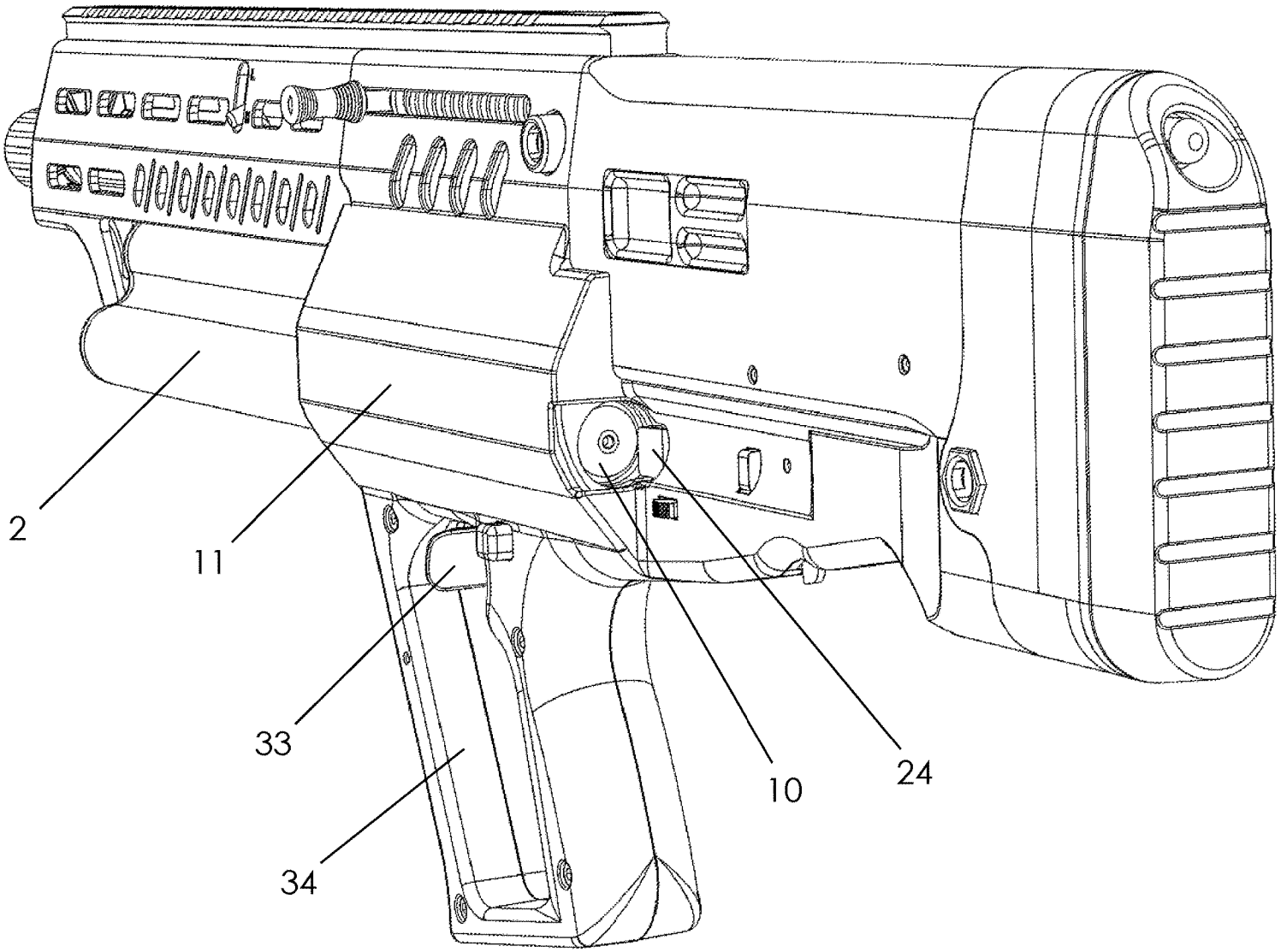
Figure 13:
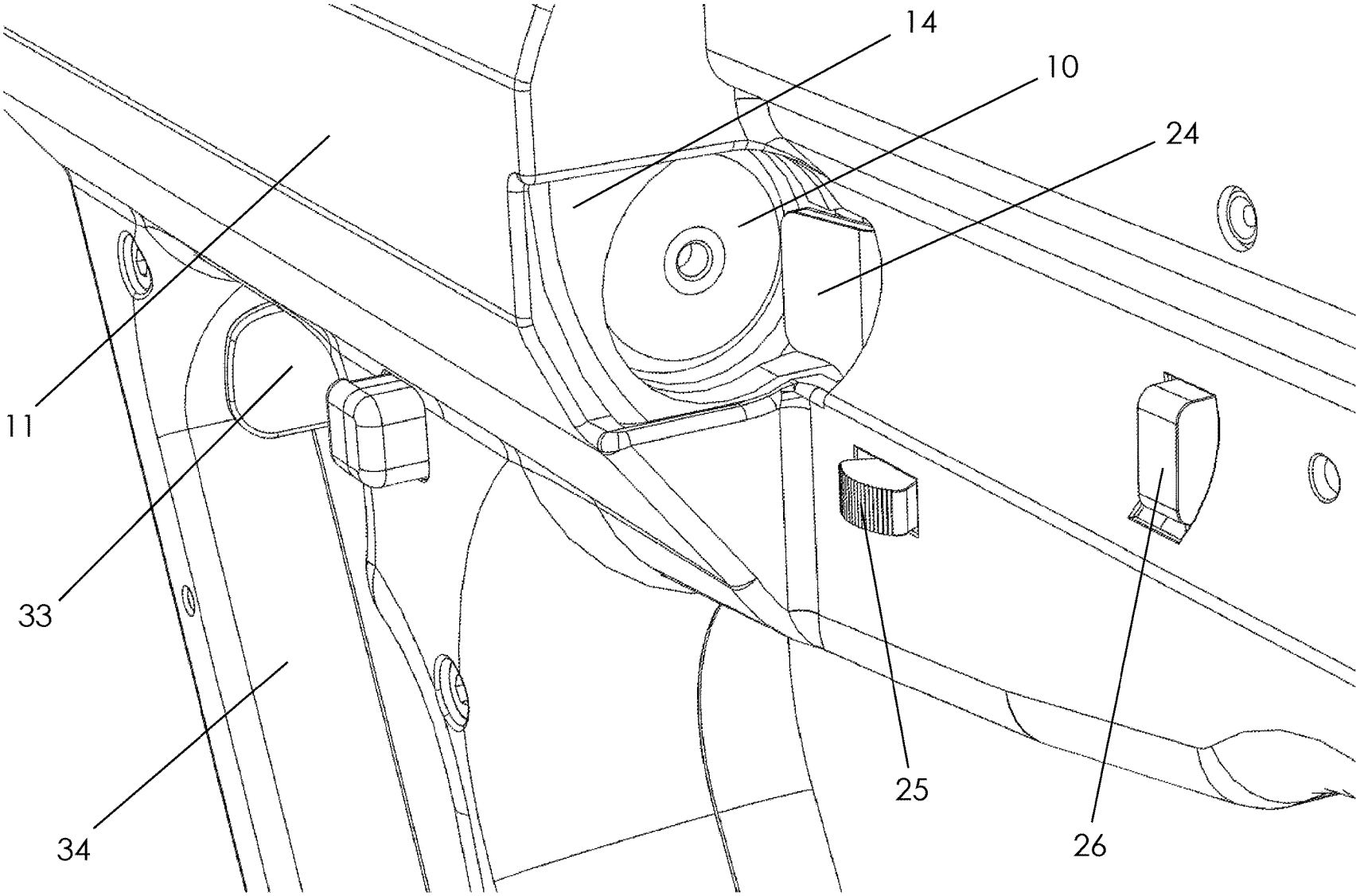

The firearm body on which the subject matter magazine structure (1) is used, as shown in FIGS. 12 and 13, is in a structure that the two magazine columns (3) which is at the lower part of the magazine structure (1) and in which the extra cartridges are stored are open outwardly. Thereby, users are able to load cartridges into the magazine columns (3) or to unload cartridges in the magazine columns (3) directly. During these procedure, users contact with the extra cartridge gaps (21).

In order to conduct cartridge loading or unloading processes properly through the extra cartridge gaps (21), there are two cartridge catch (22) structures, which are symmetric twins, on the firearm body (11). The cartridge catch (22) structures are located on both sides of the firearm body (11) right behind the extra cartridge gaps (21) in a manner to be symmetrical to each other. Cartridge catch (22) structures are uniform structures.

Figure 9:
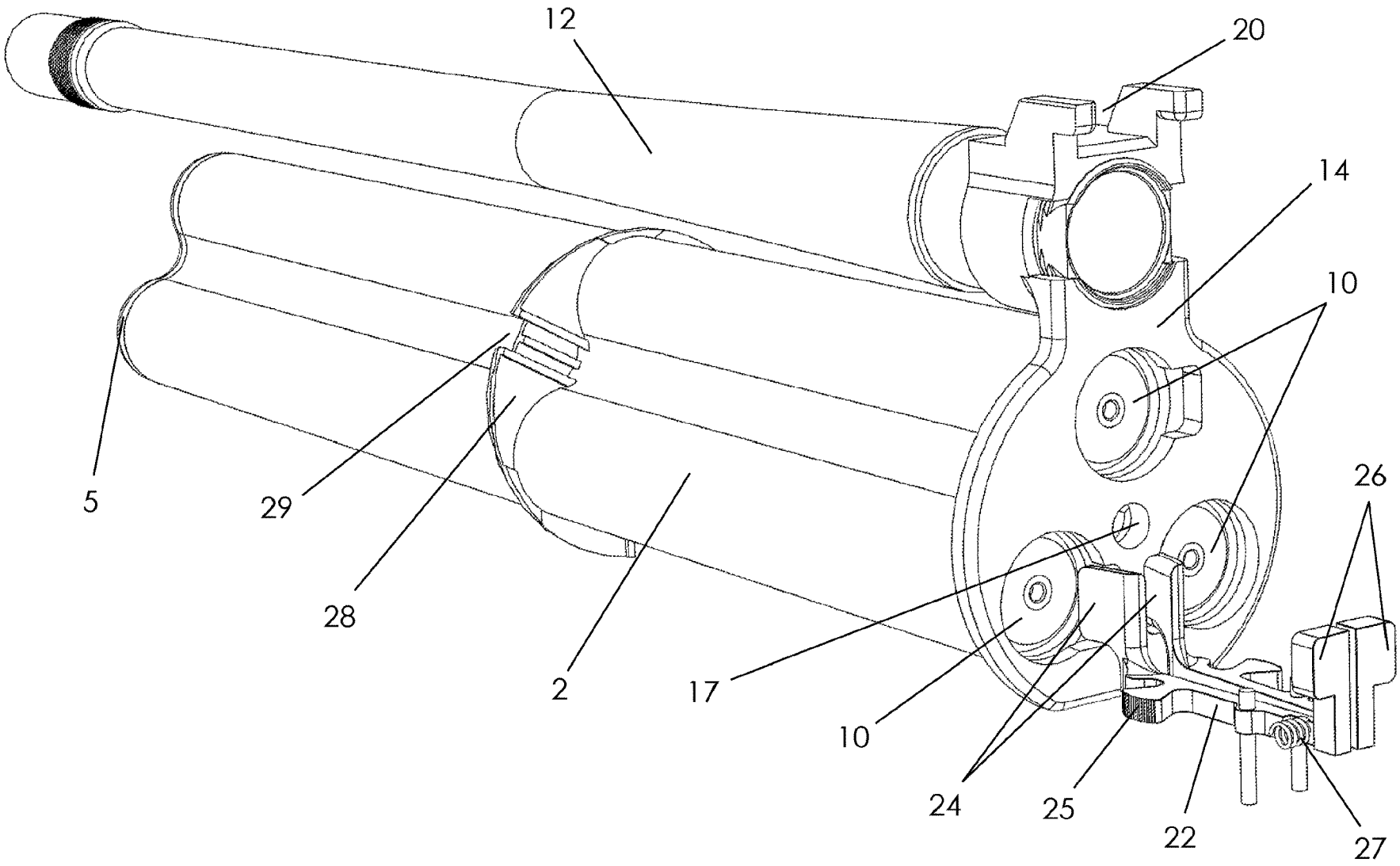

As can be seen from FIGS. 9 and 13, the cartridge catches (22) are the structures that are located inside the firearm body (11). The cartridge catches (22) are mounted on the firearm body (11) via a centering housing (23) that is located in the middle and centerline of which is vertical. Cartridge catches (22) have the capacity of a little bit rotating in horizontal axis according to centering housing (23) such that centering housing (23) is fixed by staying on the center by means of a fastener positioned in the centering housing (23). This movement capability is quite important for cartridge loading and unloading.

Figure 10:
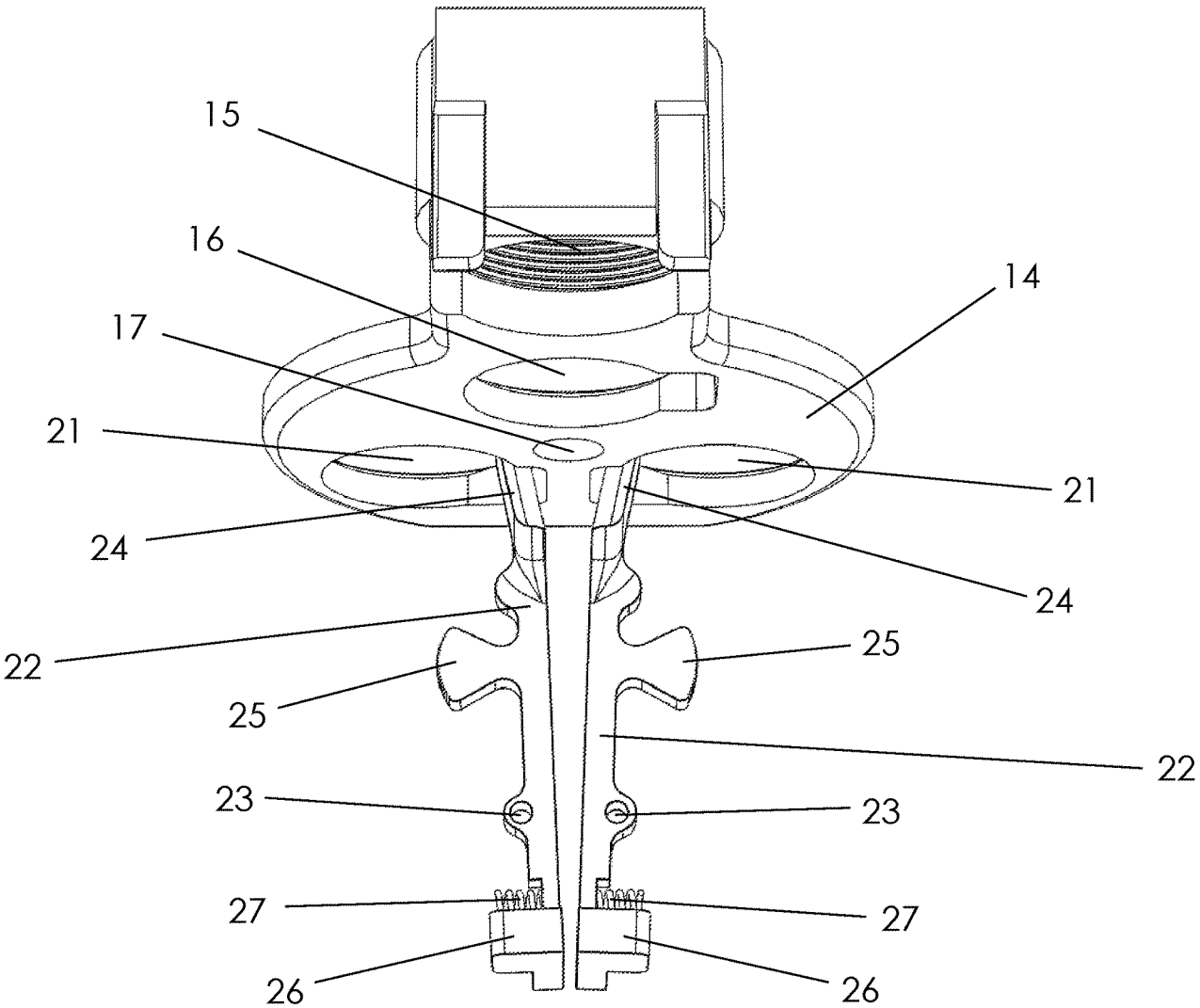

Cartridge catches (22) mainly have three structures that can be seen from outside of the firearm. First one of these structures of the cartridge catches (22) that can be clearly seen in FIG. 13 is inclined protrusion (24) located on the end that is towards the end of barrel (12) structure. The inclined protrusion (24) are structures that have some inclination to be outwardly from the firearm body (11) compared to direction of the cartridge catches (22) on the horizontal axis they have. As can be seen in FIG. 10, the inclined protrusions (24) of the cartridge catches (22) positioned such that they are side to side inside the firearm body (11) are inclined in opposite directions to each other.

When the firearm structure having the subject matter magazine structure (1) are in free position, the inclined protrusions (24) have position to be outwardly protruded in relation to the firearm body (11). Structures ensuring that the inclined protrusions (24) have position to be outwardly protruded are retainer springs (27) that are one for each and located on the outer sides of both cartridge catches (22). The retainer springs (27) are the structures that are located to be on the other side of the centering housing (23) with regard to the inclined protrusions (24) and placed to be contacted to outer edge of the cartridge catches' (22) end portion having no inclined protrusion (24). Said retainer spring are so positioned that their one end is on the inner surface of the firearm body (11) and other end is on the outer surface of the cartridge catches (22). Retainer springs (27) are in a compressed position and they push the cartridge catches (22) a fair amount towards the inside of the firearm body (11) by effect of expansive force resulting due to compression. The cartridge catches (22) that are centered from their centering housing (23) points make rotational motion on horizontal plane to be around the centering housing (23) by the effect of said force and their ends having no inclined protrusion (24) extend at an amount into the firearm body (11) while ends having inclined protrusion (24) extend at the same degree outwardly from the firearm body (11). Thereby the inclined protrusions (24) cover slightly front of the extra cartridge gaps (21). That prevents the extra cartridges in the extra cartridge gaps (21) to be ejected out by the pushing effect of the magazine springs (4) when in normal position. The inclined protrusions (24) ensures the cartridges to stay in the magazine columns (3) against the outwardly pushing effect of the springs that are compressed in the magazine columns (3).

The process needed to be done is quite simple when it is desired to load cartridge into the magazine columns (3) through the extra cartridge gaps (21). The only thing that user need to do for the above mentioned process is to push the cartridge that they want to load towards the extra cartridge gap (21) by a fair amount of force. As a result of this action, end section of the cartridge to be loaded primarily contacts to the outer side of the inclined protrusion (24) that closes the extra cartridge gap (21). When the user applies pushing force, the cartridge structure slightly pushes the inclined protrusion (24) into the firearm body (11) and thus opening inlet of the extra cartridge gap (21). The force applied by the cartridge makes the cartridge catch (22) structure to realize an amount of rotational motion in a manner that the centering housing (23) stays fixed. Meanwhile, retainer spring (27) structure contacting the related cartridge catch (22) is somewhat compressed. When back side of the cartridge that is pushed into the magazine column (3) is out of contact with the inclined protrusion (24), the inclined protrusion (27) slightly closes the inlet of the extra cartridge gap (21) by returning to its first position by the effect of compressed retainer spring (27) and prevents the cartridges that are inside to be ejected out. Thus, users are able ensure that the cartridges they desire to load into the magazine structure (1) are positioned into the magazine columns (3) by performing pushing movements with only a small amount of force.

Figure 11:
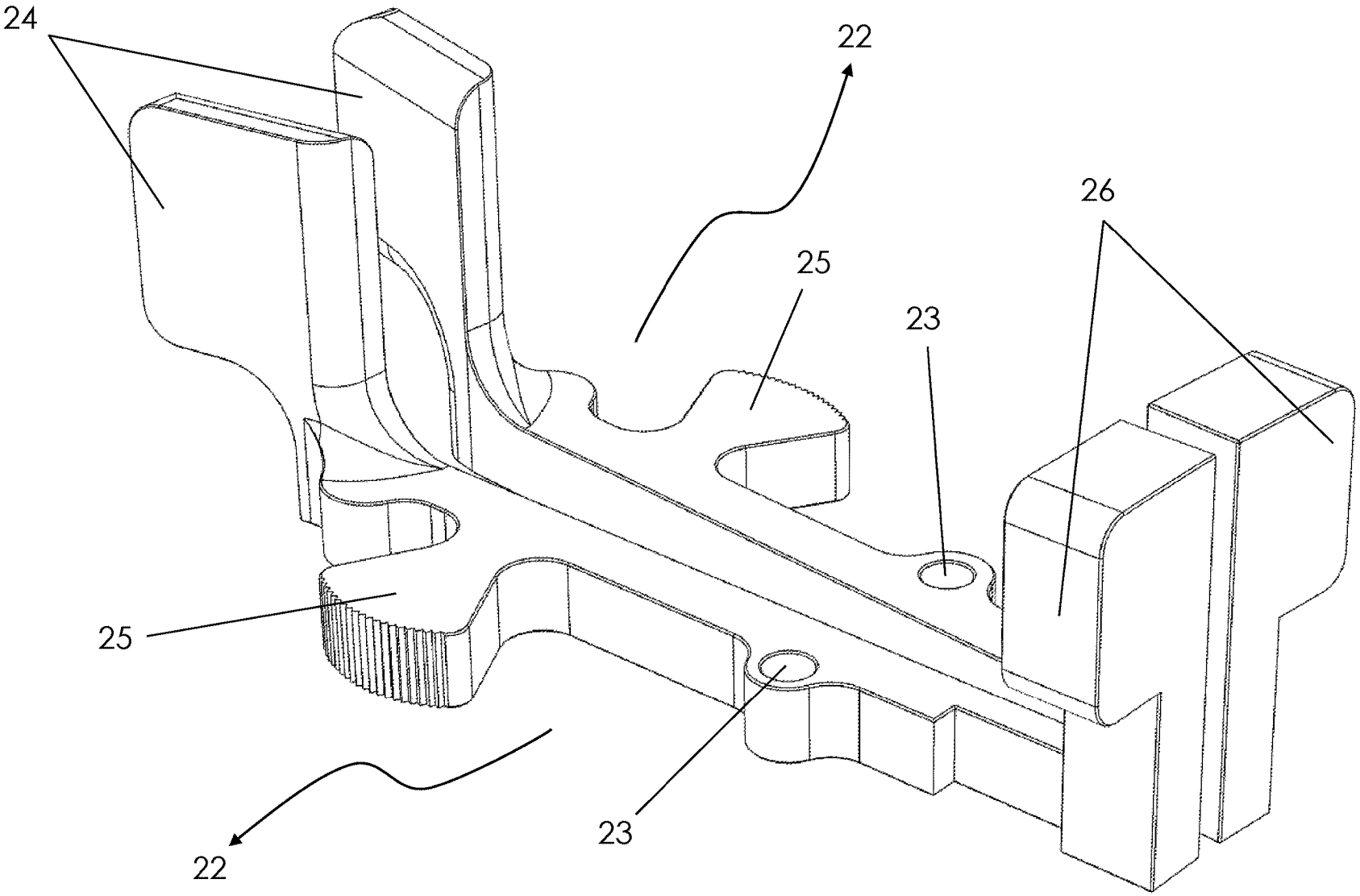

A further structure of the cartridge catch (22) is, as can be seen also in FIG. 11, a button (25) structure located in a point between the centering housing (23) and the inclined protrusion (24), and formed as a protrusion toward the outer side of the firearm body (11). Main function of the button (25) is to realize cartridge unloading process. When users want to unload the cartridges from the magazine columns having the extra cartridge gaps (21), the only thing they need to do is to slightly push the button (25) structure into the firearm body (11). By means of this movement, the cartridge catch (22) structure rotates a fair amount around the centering housing (23) that is fixated. Depending on this rotating motion, retainer spring (27) structure contacting the related cartridge catch (22) is somewhat compressed and the inclined protrusion (24) moves into the firearm body (11) ensuring the inlet of the extra cartridge gap (21) to be opened. Thus, the cartridges in the magazine columns (3) facing to the extra cartridge gaps (21) now can be ejected out without being prevented by the inclined protrusion (24). Hence, users only need to press the button (25) structure on the related side to unload the magazine column (3) they want to unload.

The last structure of the cartridge catch (22) is an inhibitor (26) structure that is located on the end facing the rear side of the firearm body (11) and formed as protrusion extending outwardly from the firearm body (11). The inhibitor (26) structure is a structure located in the firearm body (11) when the firearm body is in normal position. However, during cartridge unloading process, while the inclined protrusion (24) moves into the firearm body (11) whereas the inhibitor (26) structure extends outwardly from the firearm body (11) due to the rotational motion around the centering housing (23) occurred as a result of pushing the button (25) structure into the firearm body (11) by user. The cartridge structure that is desired to be ejected out pops out of the inlet of the extra cartridge gap (21) opened after the movement of the inclined protrusion (24) by means of the pushing effect of the magazine spring (4) thereon. However, at this moment, the inhibitor (26) structure formed as protrusion extending outwardly from the firearm body (11) prevents the cartridge structure that pops out to fly away. User are able to realize cartridge unloading process properly by means of the inhibitor (26) structure.

Figure 7:
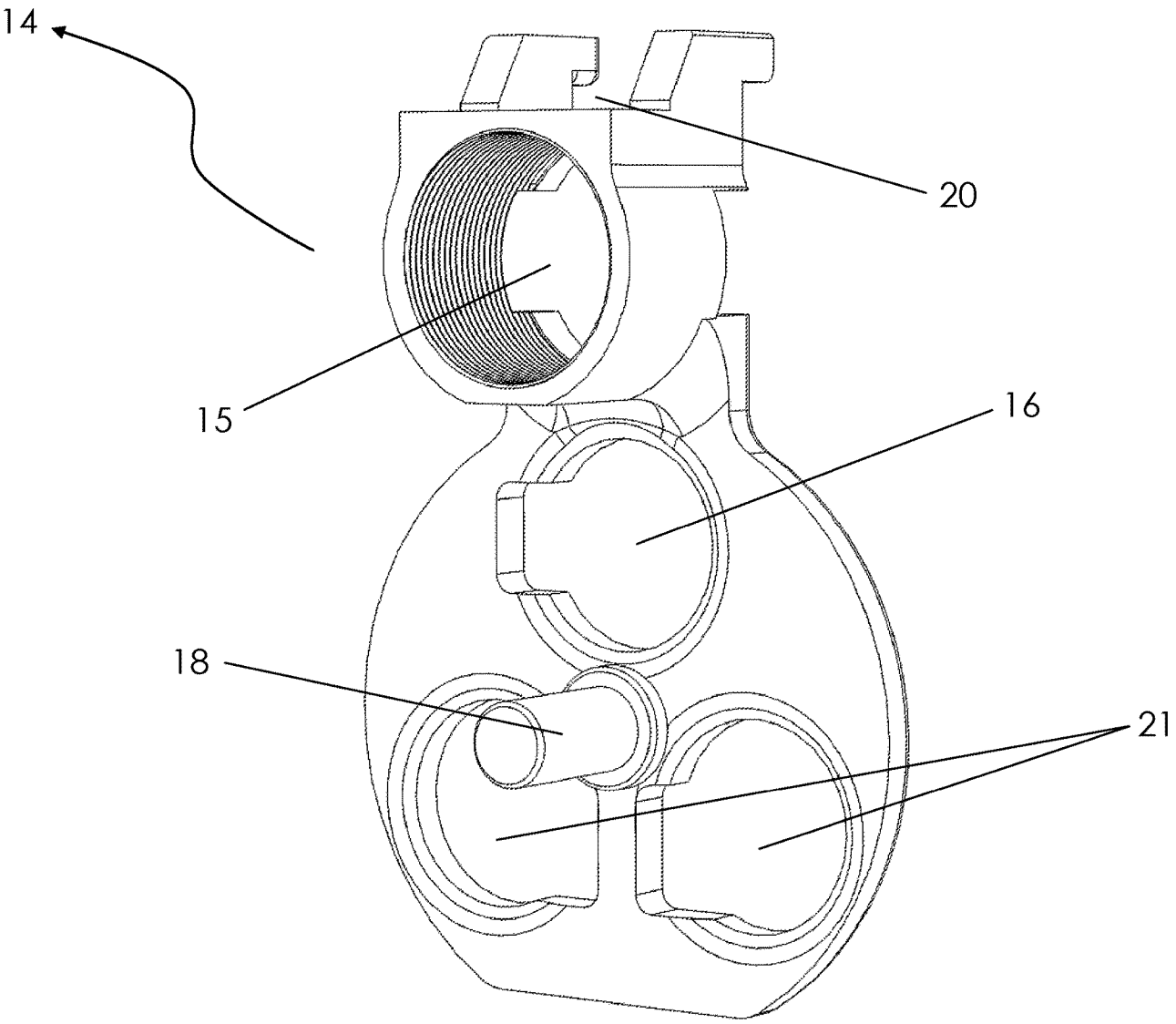
Figure 8:
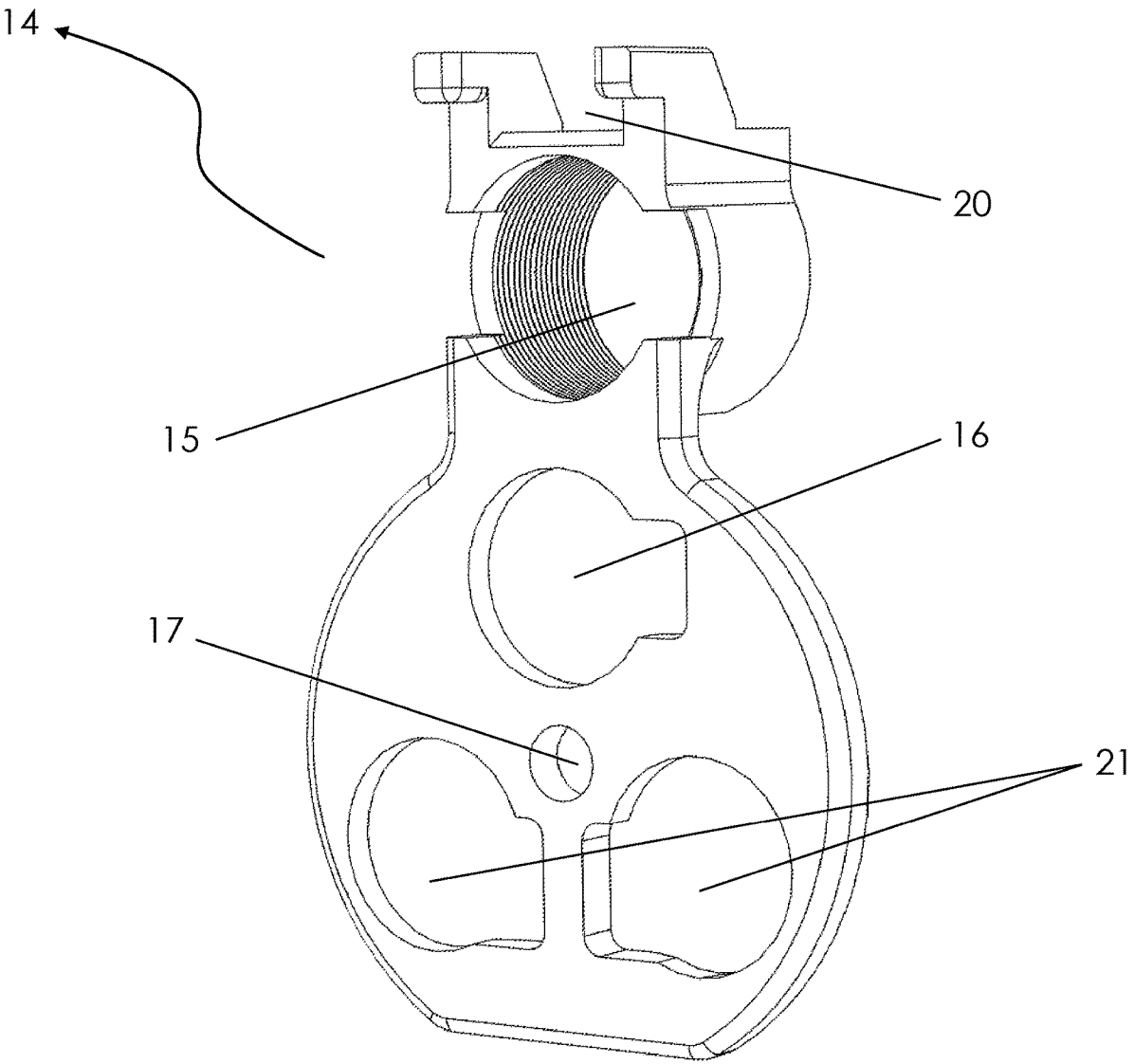

The motions of the inclined protrusion (24) within the cartridge catch (22) located in the firearm body in which the subject matter magazine structure (1) is used are highly important in order for the magazine structure (1) to function properly. Hence, the inclined protrusions (24) should be able to move freely. The inclined protrusions (24) in question are positioned to correspond on the edges of the extra cartridge gaps (21), which are side to side on the lower part of the disc structure (14) and which are close to each other. In order that the inclined protrusion (24) can move freely, as shown in FIGS. 7 and 8, there are correlatively positioned cornered gaps on the edges of the extra cartridge gaps (21) that face each other. Movements of the inclined protrusions (24) can be realized smoothly by means of the said cornered gaps located on the close ends of the extra cartridge gaps (21) such that they cover movement areas of the inclined protrusions (24) completely. The inclined protrusions (24) can move freely without being prevented by the disc structure (14) when moving by means of the cornered gap structures.

Figure 4:
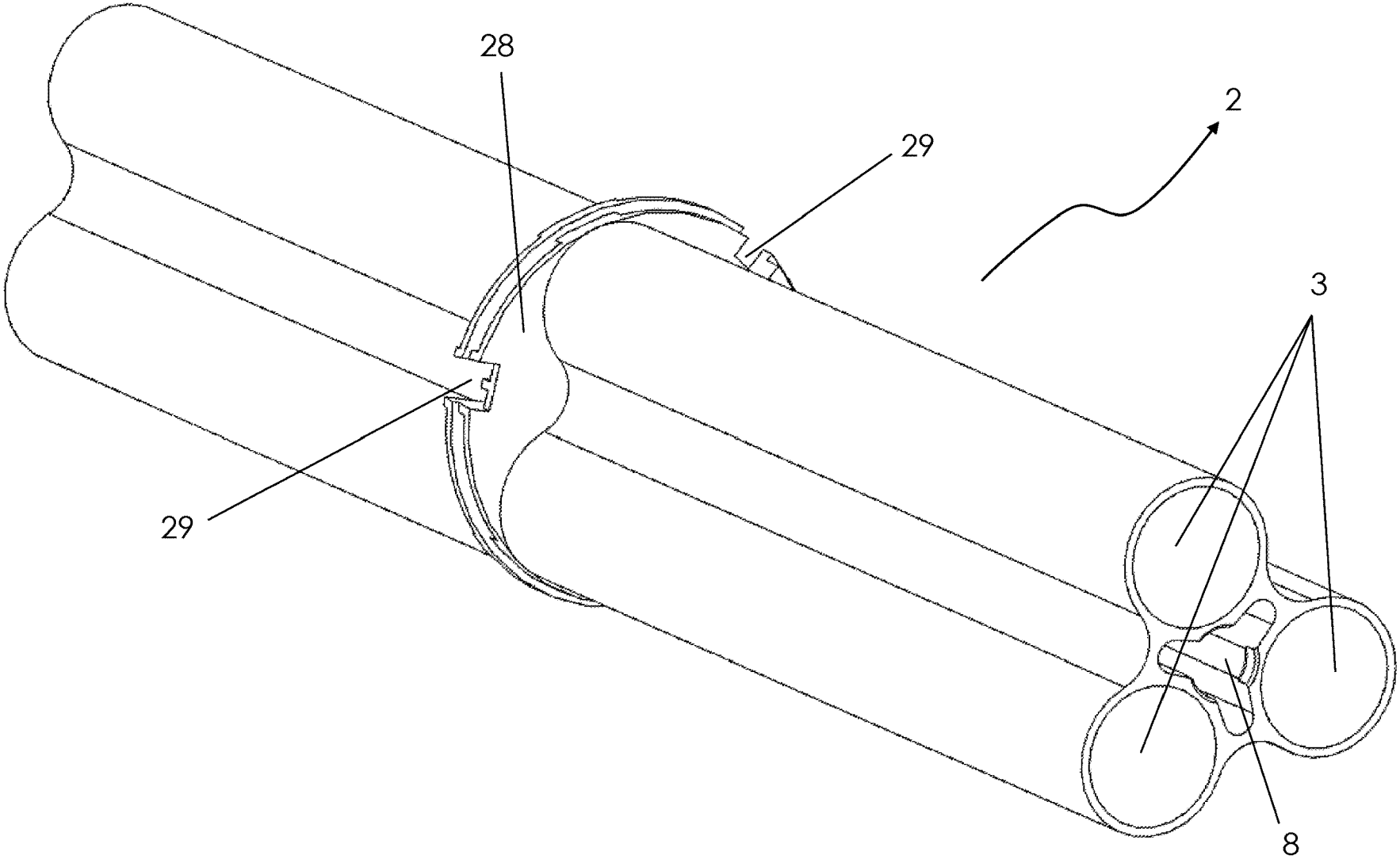
FIG. 4, Magazine Body—Rear Perspective

There is a round shaped stabilizer structure (28) having the same center as the bearing housing (8) on middle portion of the magazine body (2) of the subject matter magazine structure (1). As can be seen in FIG. 4, the stabilizer structure (28) has a diameter range that can enclose the whole magazine columns (3).

There are three locking housing (29) that are in equal distances with each other and each of which is right between the two magazine columns (3) on edges of the stabilizer structure (28). Said locking housings (2) are the structures formed as gaps. Main function of the stabilizer structure (28) is to ensure that the magazine structure (1) is secured on the firearm body (11) depending on preferred magazine columns (3). Accordingly, there is a locking latch (30) structure in trigger (38) part of the firearm body on which said magazine structure (1) is positioned, as shown in FIG. 6. Said locking latch (30) is positioned on trigger guard (34) that covers front side of pistol grip.

Figure 14:
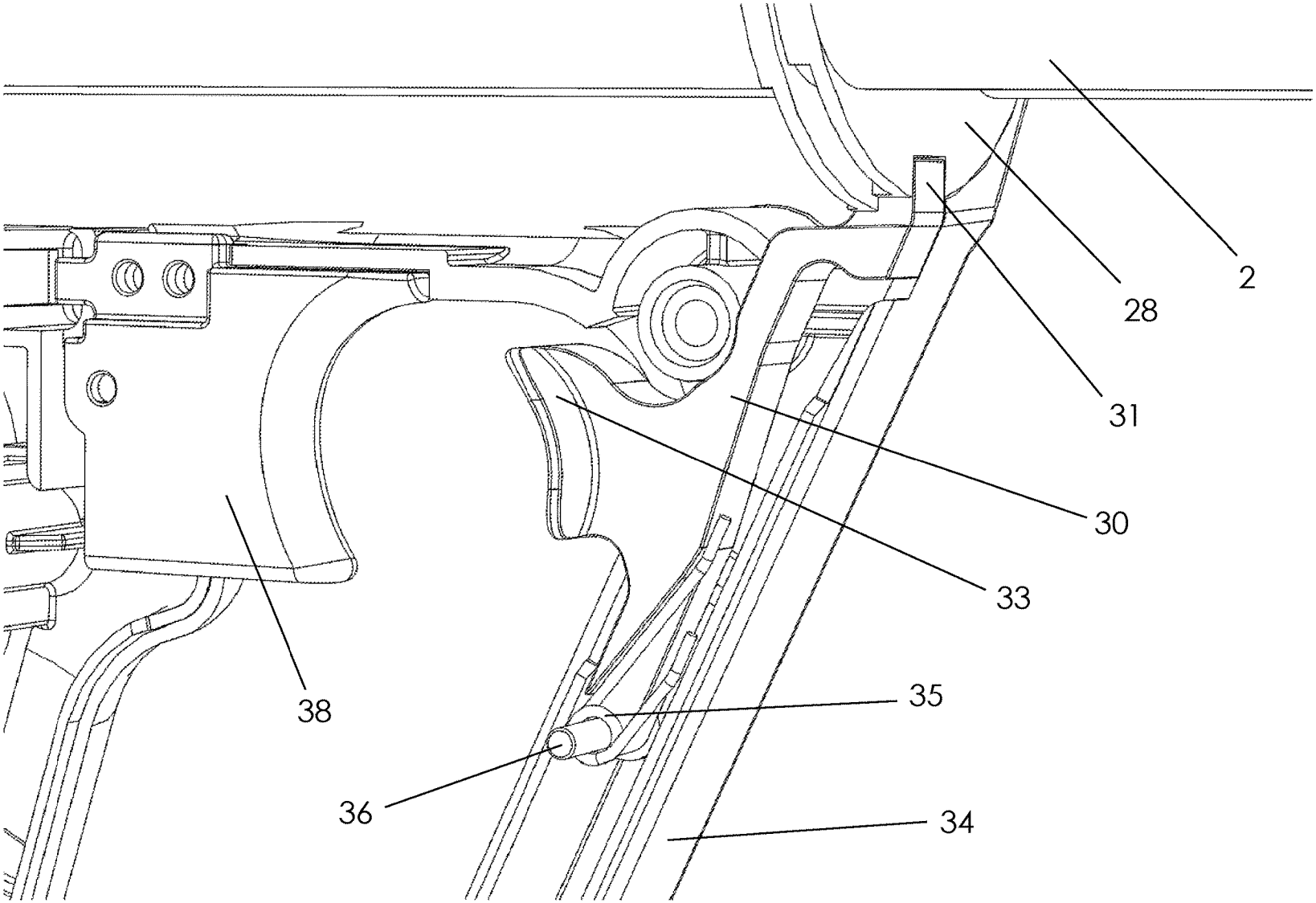
Figure 15:
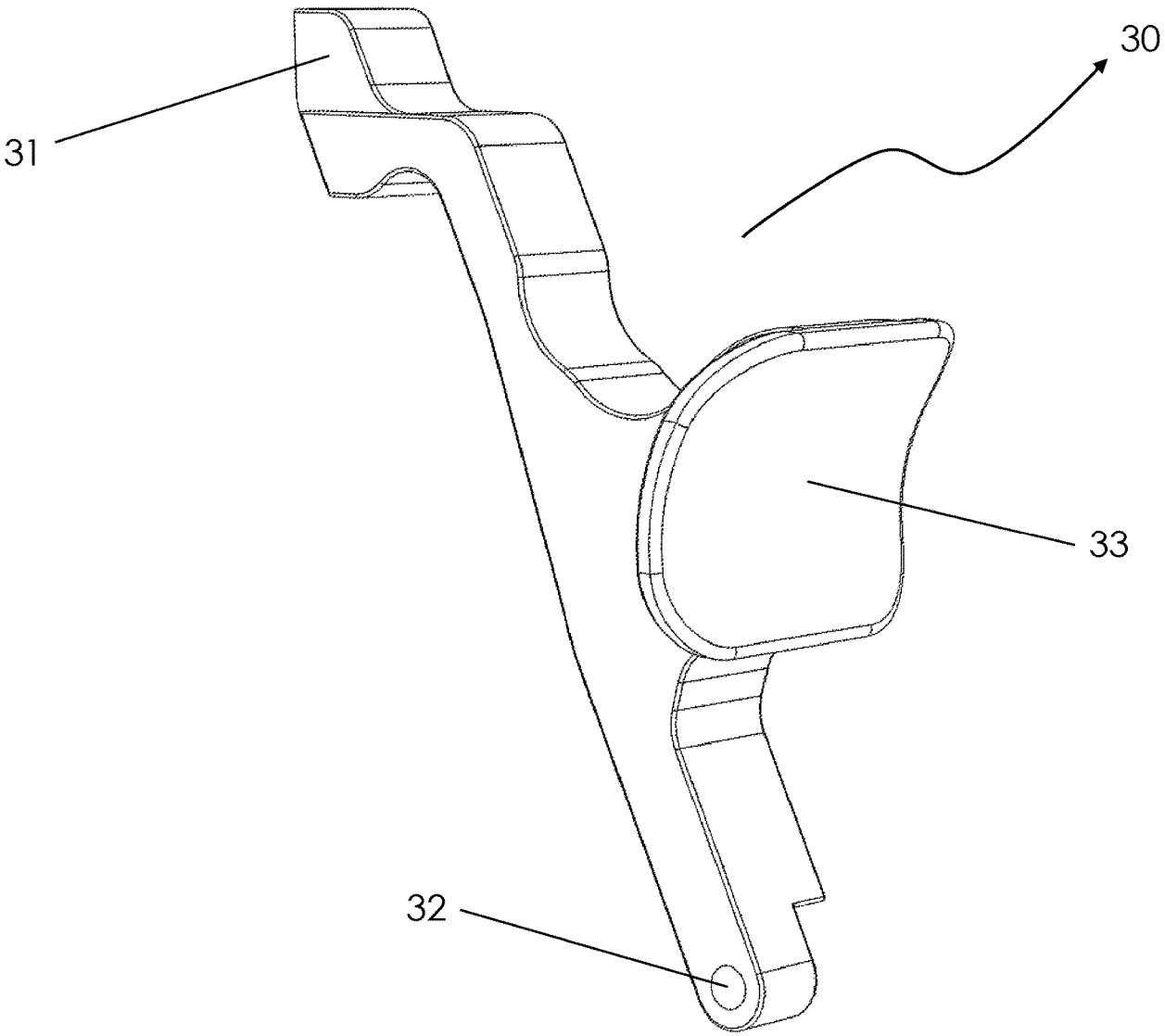

Locking latch (30) is uniform structure mainly responsible for securing the stabilizer structure (28). As can be seen in FIG. 14, it is mounted to the trigger guard (34) through latch assembly hole (32) formed as cylindrical hole, located on the lower part with regard to ground plane. It has a body structure which in general rests in parallel to the trigger guard (34). Mounting of the locking latch (30) to the trigger guard (34) is realized by locking pin (36) placed into the latch assembly hole (32).

On the upper end of the locking latch (30) there is a locking extractor (31) in a protrusion form towards the end of the barrel (12). The locking extractor (31) is a structure that can be fully fitted into the locking housings (29) on the stabilizer structure (28). By means of this property, it ensures that the magazine structure (1) is secured in a certain position. In order that the locking latch (30) is fully fitted into the locking housings (29), it needs to be pushed continuously by a little force. The force in question is provided by locking spring (35).

Figure 16:
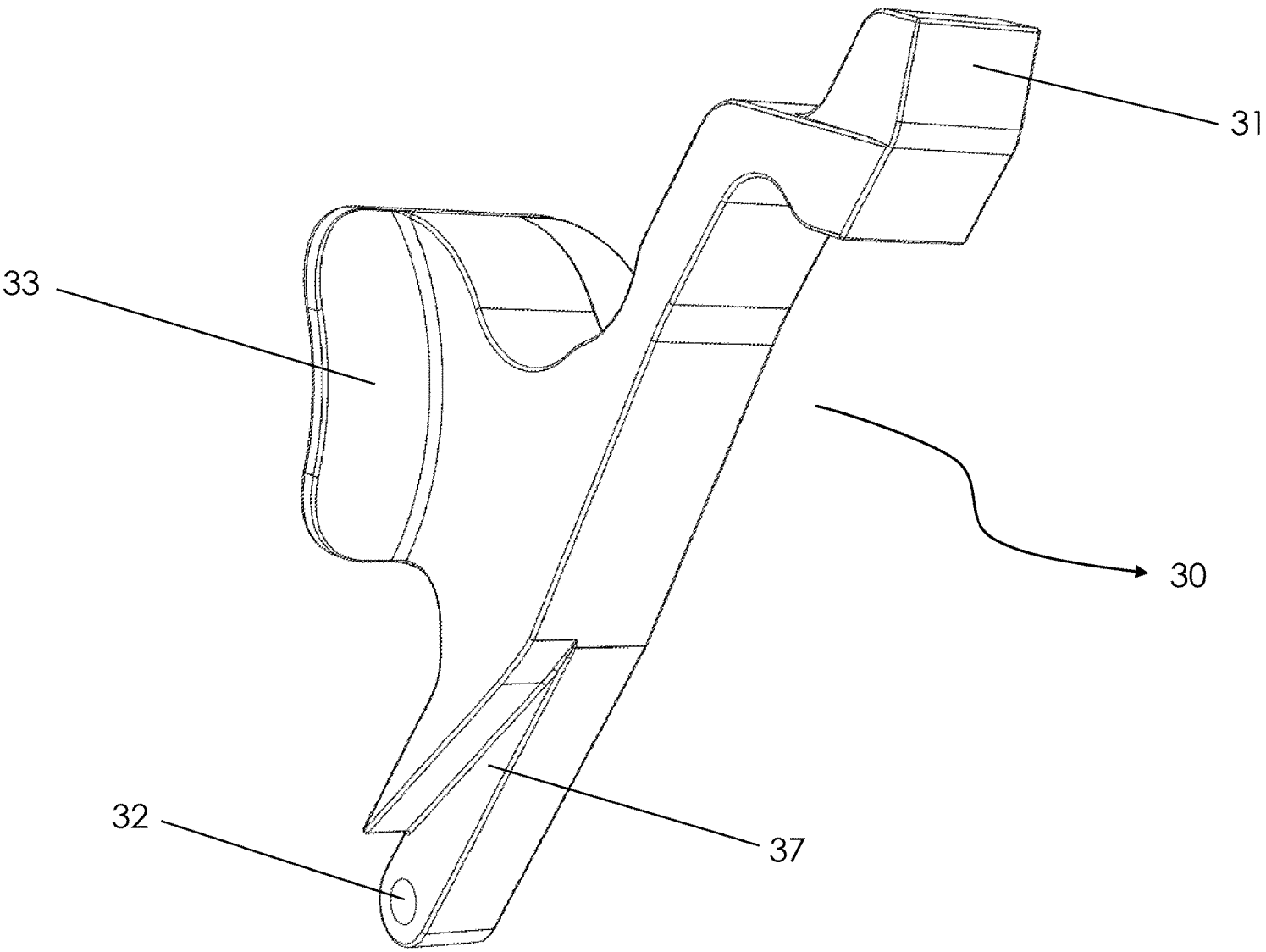

There is a spring gap (37) that is formed as a half gap right above the latch assembly hole (32) located on the lower end of the locking latch (30), as also shown in FIG. 16. One locking spring (35) is placed into this spring gap (37) and ensured to be compressed between the trigger guard (34) and the spring gap (37). In this case, the compressed locking spring (35) pushes the locking latch (30) towards the trigger (38) structure. The locking latch (30) forced towards the trigger (38) structure realizes a little rotational motion by assuming the point as center while it is secured on the trigger guard (34) via latch assembly hole (32) that is on its lowest point and makes its free end on which the locking extractor (31) is located to move towards the trigger (38) structure. With this movement, the locking extractor (31) fully fits into the locking housing (29) to which it corresponds. Thus, the stabilizer structure (28) is secured in a certain position by means of the locking latch (30). As a result, the magazine column (3) that is positioned on the upper side of the magazine structure (1) with regard to ground plane becomes the magazine column (3) containing the cartridges to be fired.

When users desire to make change between the magazine columns (3) the only thing they need to do is to move the locking extractor (31) towards the end of the barrel (12) thereby releasing it free from the locking housing (29) in which it is located. For performing that process properly, a finger housing (33) structure is formed on the locking latch (30). The finger housing (33) is a structure that is in a form to be a protrusion towards the trigger (38) structure and is located such that it is right front of user's finger which is on the trigger. The finger housing (33) is designed to be close to users' fingers on the trigger (38) structure in order for users desiring to make change between the magazine columns (3) to readily reach it and has a structure such that users can easily apply force on it by their fingers' outer sides.

The main function of the finger housing (33) is to release the magazine structure (1) free by making the locking extractor (31) free from the locking housings (29) when desired to make change between the magazine columns (3). For this process, the finger housing (33) is required to be slightly pushed by the finger on the trigger (38) towards the end of the barrel (12). By means of the force applied on the finger housing (33), the locking latch (30) secured on the trigger guard (34) via the latch assembly hole (32) realizes a small rotational motion in a manner to assume the latch assembly hole (32) as the center. Said rotational motion ensures that the locking extractor (31) is released from the locking housing (29) in which it is positioned by making the upper end that is the free end of the locking latch (30) with regard to ground plane move towards the end of the barrel (12). Thereby, the magazine structure (1) is released to realize rotational motion and user adjusts the desired magazine column (3) in position then stops applying force on the finger housing (33). After users stops applying force, pushing force of the locking spring (35) is activated again and the locking extractor (31) fits into the respective locking housing (29) by moving back towards the direction of rear portion of the firearm body (11). Thus, the magazine structure (1) cannot realize rotational motion anymore and is secured back again.

A novel automatic shotgun structure having a quite high total cartridge capacity is provided by means of the subject matter magazine structure (1). When the cartridges in a magazine column (3) is finished during shooting, it is possible to continue performing rapid fires by changing to another magazine column (3) in a very short time. By means of the fact that users are able to reload the two magazine columns (3) that are empty even during shooting, time loss during cartridge reloading is minimized. Furthermore, by means of the fact that it possible to load different type of cartridges into the different magazine columns (3) users are able to fire different type of cartridges in a controlled manner. This provides a serious advantage especially for law enforcement officers such as policeman and soldiers who may use different type of cartridges.

The invention claimed is:

1. A firearm structure having a novel magazine system, components:

a magazine structure located in a magazine port of a firearm structure and having a rotatable structure on its centerline, and comprising a tubular type uniform magazine body comprising a combination of cylindrically formed three magazine tubes positioned in parallel and equidistant to each other; a round shaped stabilizer structure located as protruded outwardly on an outer surface of a middle section of the magazine body and ensuring position of the magazine structure to be secured by three locking housings in a gap form positioned with equal distances on the edge thereof; a magazine lid which has a structure to seat on any end of the magazine structure that is formed as triple tube, and which encloses an end of the magazine body that is on the same direction with end of the barrel and protrusion-wise formed symmetrical three column taps of which can be fitted into three magazine columns at the same time;

a disc structure located right at the rear end of the magazine structure, assisting in loading cartridges to be fired into the barrel properly, securing the connection between the magazine structure and firearm mechanism, having three round holes fully fitting to the magazine columns large enough for three cartridges on its lower portion, and on its upper portion having a fourth hole-like formed round barrel housing located on a point right above said three holes, wherein the barrel housing is formed as a cylindrical hole slightly protruding towards the barrel end in order that the barrel structure can be positioned into the said barrel housing;

a locking extractor which is located on a trigger guard enclosing a front side of a pistol grip, and upper end of which contact to a stabilizer structure on the magazine structure, and which has a finger housing positioned on its middle section such that it faces the user's finger on a trigger structure, and which has a locking extractor formed as a protrusion that can be fitted on the locking housings on the stabilizer structure on its upper end and which secures the magazine structure in a fixated position;

two cartridge catches which are positioned symmetrically right behind extra cartridge gaps that are two rounded holes located as side to side at a lower part of a disc structure, and which close outlet of the extra cartridge gaps in the lower portion of the disc structure thereby preventing the cartridge structures that may pass through these holes from ejecting out, and which allow the cartridge structures that are pushed into the extra cartridge gaps to pass through the inlet of the extra cartridge gaps, and which are symmetrical twins with regard to each other.

2. The firearm structure of claim 1, wherein the magazine structure comprises:

three magazine springs positioned in the magazine columns of the magazine body such that each magazine column contains one of them, and one end of them fits onto one of the column taps of the magazine lid and ensuring that cartridge structures in the magazine columns to move towards the disc structure; a bearing housing located right at the middle of the magazine columns on the end of magazine body to which the magazine lid is mounted, ensuring that the magazine lid can be mounted on the magazine body and formed as a gap into which a central bearing can be tightly seated; an engagement gap located right at the middle of the magazine columns on the end of magazine body that faces to the disc structure, ensuring that the magazine body can be mounted on the magazine disc and formed as a gap into which a pin structure can be positioned; three spring taps each one of which is contained in the magazine columns, positioned on the end portions, that face the disc structure, of the magazine springs inside the magazine columns, able to move within the magazine columns depending on the movements of the magazine springs and assisting in pushing the cartridge structures inside the magazine columns towards the disc structure by the magazine springs; a central bearing which is structured to be fully fitted into a bearing gap that is right on the middle point of the magazine lid, and wherein its one end passing through the bearing gap fully fits into the bearing housing, and which ensures that the magazine lid is mounted on the magazine body.

3. The firearm structure of claim 1, wherein the disc structure comprises:

an assembly gap which is positioned on the barrel housing that is on the upper of the disc structure and formed as a gap on which a mechanism rail that aligns mechanism of the firearm structure with the barrel can be fully fitted; a main cartridge gap which is positioned right under the barrel housing, which is formed as a round hole large enough for a cartridge to pass through, which fully fits to the magazine column, that keeps the cartridge to be fired, of the magazine structure on the upper part, and which provides a proper operation for the firearm mechanism by allowing the cartridge to be loaded from the magazine structure into the barrel for shooting to pass there-through; two extra cartridge gaps which is positioned side to side at the lower part of the disc structure, and formed as symmetrical round holes large enough for cartridges to pass through them, and which fully fit to the two magazine columns in which cartridges not yet to be fired are stored on the lower part of the magazine structure, and which have mutually positioned symmetrical cornered gaps for fully covering movement areas of inclined protrusions on their edges close to each other in order not to prevent the movements of the inclined protrusions, and which ensures that the magazine structure can realize cartridge loading unloading processes; a pin housing which is positioned right middle of the extra cartridge gaps having equidistant to each other at the lower part of the disc structure and the main cartridge gap structure, and which ensures that the disc structure and the magazine structure are mounted to each other via the pin structure positioned therein, and which fully fits on the engagement gap on the rear end of the magazine structure and which is formed as a gap in which the pin structure can be positioned.

4. The firearm structure of claim 1, wherein the cartridge catches comprise:

a centering housing which is formed as a cylindrical gap, and which is positioned in a point on middle section of the cartridge catch such that its centerline extends in vertical direction, and which allows the positioning of the cartridge catch structure on the firearm body by means of a fastener positioned therein; an inclined protrusion which is positioned on end portions, facing the disc structure, of the cartridge catches that is positioned behind the extra cartridge gaps, which is in outwardly protruded form in a manner to be outwardly from the firearm body on horizontal axis and which prevents cartridge structures located in the extra cartridge gaps to move out by means of a force applied on the cartridge catch by a retainer spring positioned to a point farther from the centering housing with regard to itself in a manner to correspond to outer surface of the cartridge catch; a button which is positioned to a point on the cartridge catch to be between the centering housing and the inclined protrusion structure, and which is a fair amount protruded to be outwardly from the firearm body and which assists in unloading cartridge structures located in the extra cartridge gaps; an inhibitor which is located at end, facing rear side of the firearm body, of the cartridge catch, and which is a fair amount protruded to be outwardly from the firearm body and which prevents each cartridge structure unloaded during unloading process of cartridge structures located in the extra cartridge gaps to fly away by stopping them when they pop out.

5. The firearm structure of claim 1, wherein the locking extractor comprises:

a latch assembly hole formed as a cylindrical gap, located at lower end of the locking latch with respect to ground plane, and ensuring that the locking latch is mounted on the trigger guard via a locking pin placed therein; a spring gap which is located right above the latch assembly hole, and which assists the stabilizer structure to be secured in a certain position by making locking extractor to be fitted on the respective locking housing by means of a locking spring placed on a gap of it.

* * * * *